US009751743B2

(12) United States Patent
Taradalsky et al.

(10) Patent No.: US 9,751,743 B2
(45) Date of Patent: Sep. 5, 2017

(54) WINE DISPENSER

(71) Applicant: Napa Technology, Campbell, CA (US)

(72) Inventors: Morris Taradalsky, San Jose, CA (US); Nick Moezidis, San Jose, CA (US)

( * ) Notice: Subject to any disclaimer, the term of this patent is extended or adjusted under 35 U.S.C. 154(b) by 261 days.

(21) Appl. No.: 14/715,084

(22) Filed: May 18, 2015

(65) Prior Publication Data

US 2015/0329344 A1 Nov. 19, 2015

Related U.S. Application Data

(60) Provisional application No. 61/994,669, filed on May 16, 2014.

(51) Int. Cl.

| | |
|---|---|
| ***B67D 1/04*** | (2006.01) |
| ***B67D 1/08*** | (2006.01) |
| ***B67D 1/12*** | (2006.01) |
| ***B67D 1/00*** | (2006.01) |

(52) U.S. Cl.

CPC ..... *B67D 1/0412* (2013.01); *B67D 1/0004* (2013.01); *B67D 1/0885* (2013.01); *B67D 1/1279* (2013.01); *B67D 1/1252* (2013.01)

(58) Field of Classification Search

CPC .. B67D 1/0412; B67D 1/0004; B67D 1/0885; B67D 1/1279; B67D 1/1252

USPC ..... 222/400.7, 396, 399

See application file for complete search history.

(56) References Cited

U.S. PATENT DOCUMENTS

| | | | | |
|---|---|---|---|---|
| 4,473,174 | A * | 9/1984 | Heuser | B67D 1/0412 215/311 |
| 7,047,762 | B2 * | 5/2006 | Luzaich | A23L 3/00 62/3.2 |
| 7,712,631 | B2 | 5/2010 | Taradalsky et al. | |
| 7,726,355 | B2 * | 6/2010 | Lemme | B65B 31/047 141/302 |
| 9,272,834 | B2 * | 3/2016 | Bazoberry | A23L 2/44 |
| 2010/0155419 | A1 * | 6/2010 | Nishino | B67D 1/04 222/81 |

* cited by examiner

*Primary Examiner* — Donnell Long
(74) *Attorney, Agent, or Firm* — David Schneck

(57) ABSTRACT

A wine dispensing device including a housing holding a gas cylinder. A stem from the gas cylinder extends to the front of the housing and provides gas to a dispense head mounted on a wine bottle. An arm attached to a routing mechanism at the top of the housing allow manipulation of a router on the dispense head. Manipulation by the routing mechanism in a first action purges the gas within the bottle and replaces it with an inert gas. Manipulation by the routing mechanism in a second action dispenses liquid from the bottle.

6 Claims, 10 Drawing Sheets

*Fig. 1* *(Prior Art)*

*Fig. 2* *(Prior Art)*

WINE DISPENSER

CROSS-REFERENCE TO RELATED APPLICATION

This application claims priority under 35 U.S.C. 119(e) from prior U.S. provisional application 61/994,669, filed May 16, 2014.

TECHNICAL FIELD

The embodiments relate to a method and device for dispensing liquid, and specifically to a mechanical dispenser that utilizes a preserving gas but does not require a power source.

BACKGROUND ART

Machines for dispensing liquids, such as wine, have been marketed for a number of years. One example is the Wine Station® brand liquid dispensing device sold by Napa Technologies®, Inc. of Campbell, Calif. This machine has complex electronic systems to allow for precision pouring of wine (for example in 1 ounce, 3 ounce, or 6 ounce pours), display of information (for example, wine name and pricing), collection and storage of data (including volume poured, information on users, time and date of pour, remaining inventory, errors from improper insertion of a bottle or other problem, etc.) and detection of specific users or operators (for example, using smart cards readers or other card readers). Such features have proved useful in a commercial setting. One object is to provide a simpler system for home use that still allows preservation and dispensing of wine, but does not require electrical systems.

SUMMARY

A wine dispensing device including a housing holding a gas cylinder. A stem from the gas cylinder extends to the front of the housing and provides gas to a dispense head mounted on a wine bottle. An arm attached to a routing mechanism at the top of the housing allow manipulation of a router on the dispense head. Manipulation by the routing mechanism in a first action purges the gas within the bottle and replaces it with an inert gas. Manipulation by the routing mechanism in a second action dispenses liquid from the bottle.

One embodiment includes a wine dispenser including a housing having a base, front, rear and top joined together. Enclosed within the housing is a gas tank having a gas stem extending towards the front of the housing. Within the front of the housing is a bay having opposing slots for receiving a dispense head. The dispense head is sealingly mounted onto the neck of a wine bottle. The rear of the dispense head has a gas input port that receives gas from the gas stem when the dispense head is inserted. An arm extends from the housing below the housing top. The arm is joined to a mechanical valve rotator which allows engagement with a tab on a dispense head. The tab may be rotated in two directions. Rotation in a first direction purges the gas in the head space above the wine and replaces it with an inert gas from the gas tank. Rotation in a second direction allows wine to flow into an intake tube on the dispense head and to a dispense spout.

DETAILED DESCRIPTION

Figure 1:
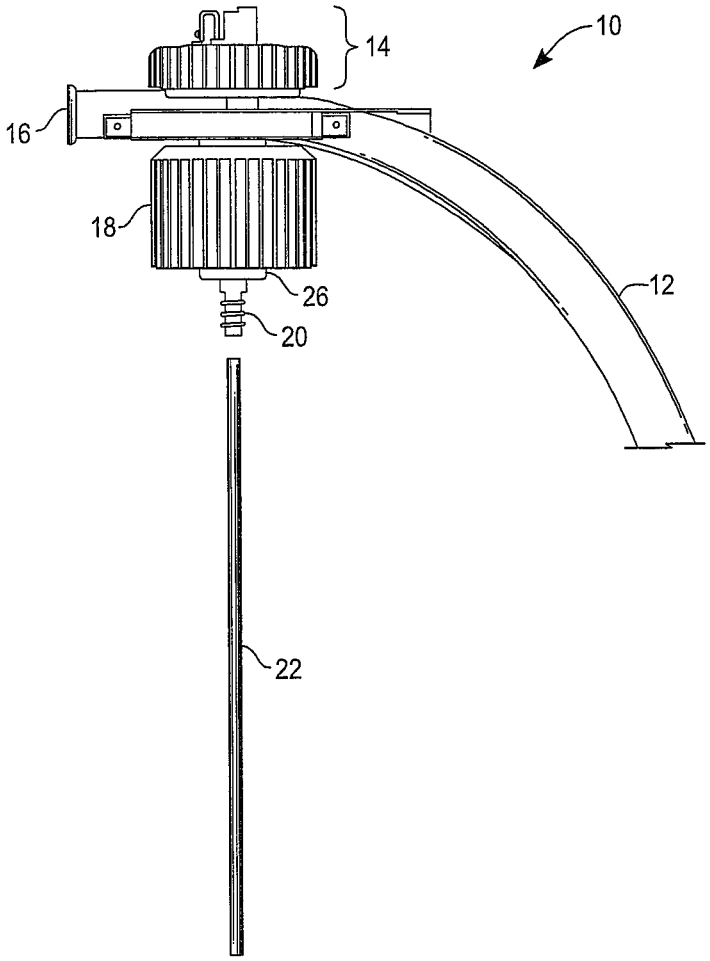
FIG. 1 is a side view of a dispense head with the intake tube detached.

One unique and advantageous feature of the Wine Station wine dispensing system is the unique dispense head. With reference to FIG. 1, a profile of a dispense head 10 is shown. This dispense head includes a gas input 16 positioned at the rear of the dispense head when the dispense head is inserted into a wine dispensing machine. Gas input 16 then forms a gas-tight seal with a gas output on the machine. A metered amount of gas then flows through the machine to displace wine.

Opposite the gas input 16 is dispense spout 12. Dispense spout 12 is a hollow tube through which wine flows when wine is dispensed by the dispensing system. A rotatable valve assembly 14 is also controlled by the wine dispensing system when dispense head 10 is attached to a wine bottle and the dispense head inserted into the wine dispense machine such that gas input 16 mates with a gas output on the wine dispensing machine. Rotatable valve assembly may be rotated such that different channels within the rotatable valve assembly 14 align with different passageways within the dispense head. For example, the gas input may be simply aligned with the dispense spout 12 (either directly or as channeled through the tapered cylinder 26 dispense head 10). A puff of gas will pass through the dispense spout 12. This allows the dispense spout 12 to be cleared of any fluid which may be retained within the dispense spout. On the lower side of the dispense head 10 under the valve assembly 14 is an annular cap 18 which sits over the neck of a wine bottle. Within cap 18 is the tapered cylinder 26 which fits into the neck of a wine bottle. At the lower end of the tapered cylinder 26 is a tube mount 20. Onto mount 20 a tube 22 is mounted. This tube 22 extends to the bottom of a wine bottle. When gas flows from gas input 16 through holes on tapered cylinder 26, (and there is no other outlet for the gas), a volume of wine is displaced by the gas and will flow into the open bottom end of tube 22 and into a channel in the dispense head 10 and out dispense spout 12. By metering the gas, selected volume of wine is achieved.

Figure 2:
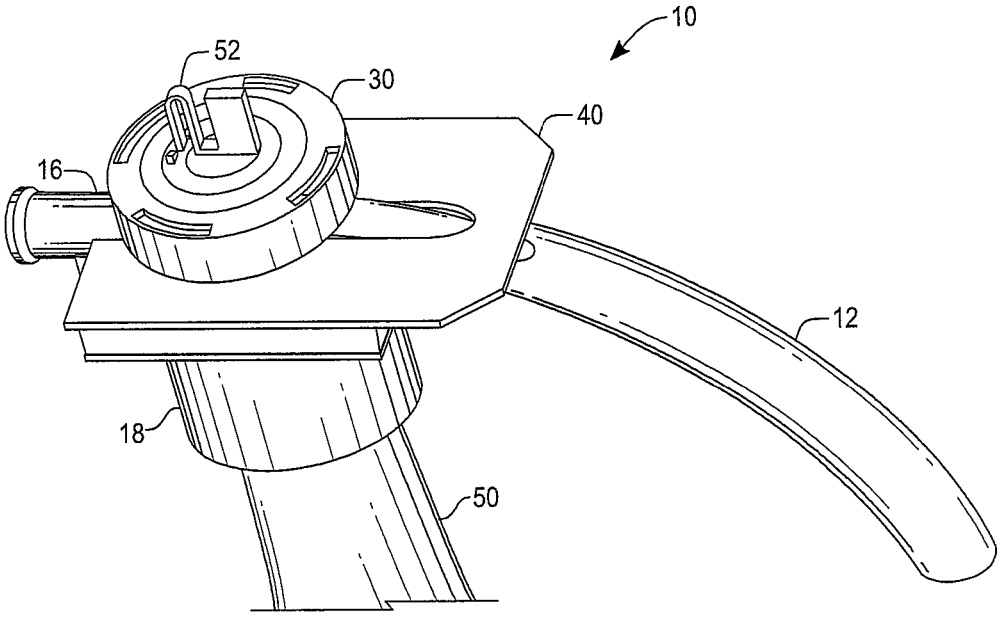
FIG. 2 is a top perspective view of the dispense head of FIG. 1, as mounted on a wine bottle.

FIG. 2 shows another view of the dispense head 10 attached to wine bottle neck 50. As seen above, cap 18 covers the top of wine bottle neck 50. Gas input 16 is opposite dispense spout 12. On the body 40 of dispense head 10 is a valve assembly cap 30. Extending from valve assembly cap 30 is a rotatable tab 52. When rotatable tab 52 is rotated (for example, by the motor driven rotating element in the wine dispensing system) different pathways for gas and liquid travel are aligned. For example, if a channel from gas input 16 is blocked by rotation of rotatable tab 52 no gas will flow through the system. This affectively seals the wine bottle as long as any channel leading to dispense spout 12 is also blocked. The sealed wine bottle can then be removed (as long as the rotatable tab 52 remains in this orientation). The bottle can be removed from a wine dispensing system and stored, or replaced with an alternative wine bottle.

In a second operation, the channel leading from gas input 16 is connected through to the channel leading into the tapered cylinder 26. This would cause liquid to flow through tube 22 (shown in FIG. 1), and into a channel in the dispense head 10 that leads to the dispense spout 12.

In a third operation, rotation of rotatable tab 52 directly connects the gas input 16 to dispense spout 12. This allows a puff of air to flow through the dispense spout to clear it of any liquid. The different pathways allow a number of selectable operations—such as "purge", "pour" and "puff". "Purge" is the operation in which the head of gas over the liquid contained in a wine bottle is replaced with an inert gas. This allows preservation of the wine. An inert gas is both introduced and removed through the stopper in the neck of a wine bottle. In the pour operation, gas is introduced into the head space over the liquid in a stoppered wine bottle. This displaces a volume of wine, which travels to the spout through the intake tube. The final operation is the "puff" in which the spout is cleared with a gas puff.

Figure 3:
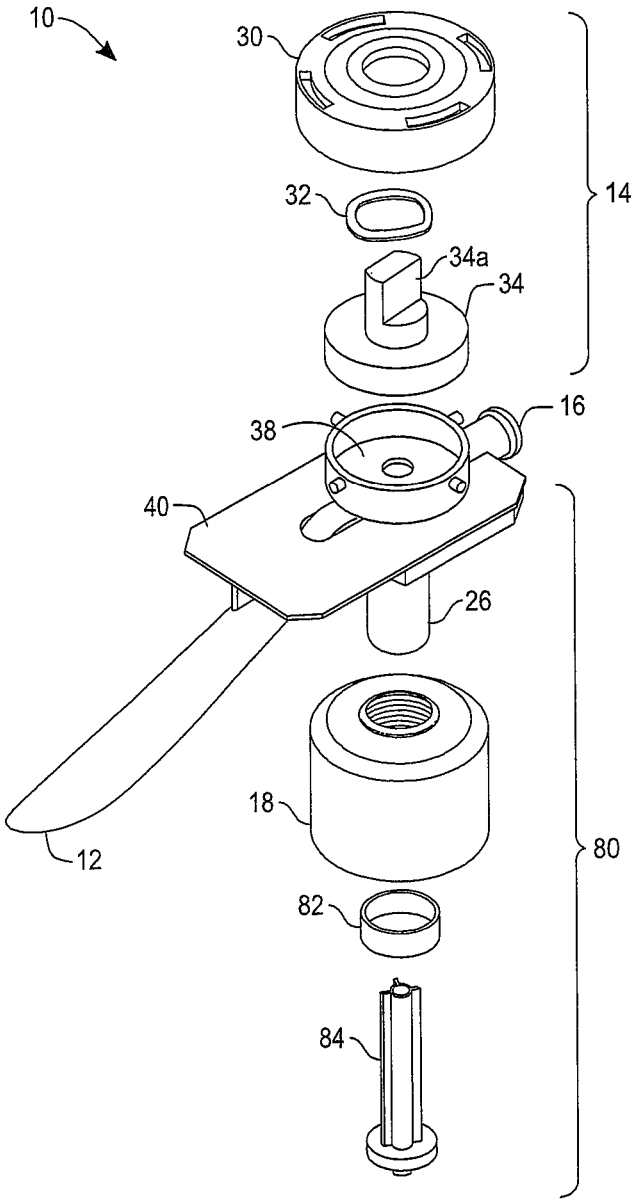
Fig. 3 (Prior Art)
FIG. 3 is an exploded view of the dispense head of FIG. 1.

With reference to FIG. 3, an exploded view of the dispense head 10 again shows the body 40 of dispense head 10 having a dispense spout 12 at one end, and a gas input 16 at the opposite end. A cap 18 is affixed below body 40 and extends above the open end of the wine bottle when the dispense head 10 is attached to the wine bottle. Seated in the valve mount 38 on body 40 is the rotatable valve assembly 14. This includes the valve assembly cap 30 positioned over rotating valve 34. The channels discussed above allowing connections of the gas input and wine output are on the underside of rotating valve 34. This can be seen in U.S. Pat. No. 7,712,631 which is hereby incorporated by reference for all purposes herein. Rotating valve 34 has a tab 34A which may be rotated by the wine dispensing system. An inner O-ring seal 32 seals rotating valve 34 to valve assembly cap 30 to prevent leaks.

The underside of the dispense head 10 includes a bottle mount assembly 80. This includes a cap 18 which extends around the neck of the wine bottle. Within cap 18 are tapered cylinder 26 which fits into a wine bottle neck, as shown in FIG. 2. A retainer ring 82 holds intake tube mount 84. This provides the channel through which the wine will flow when wine is dispersed.

Figure 4:
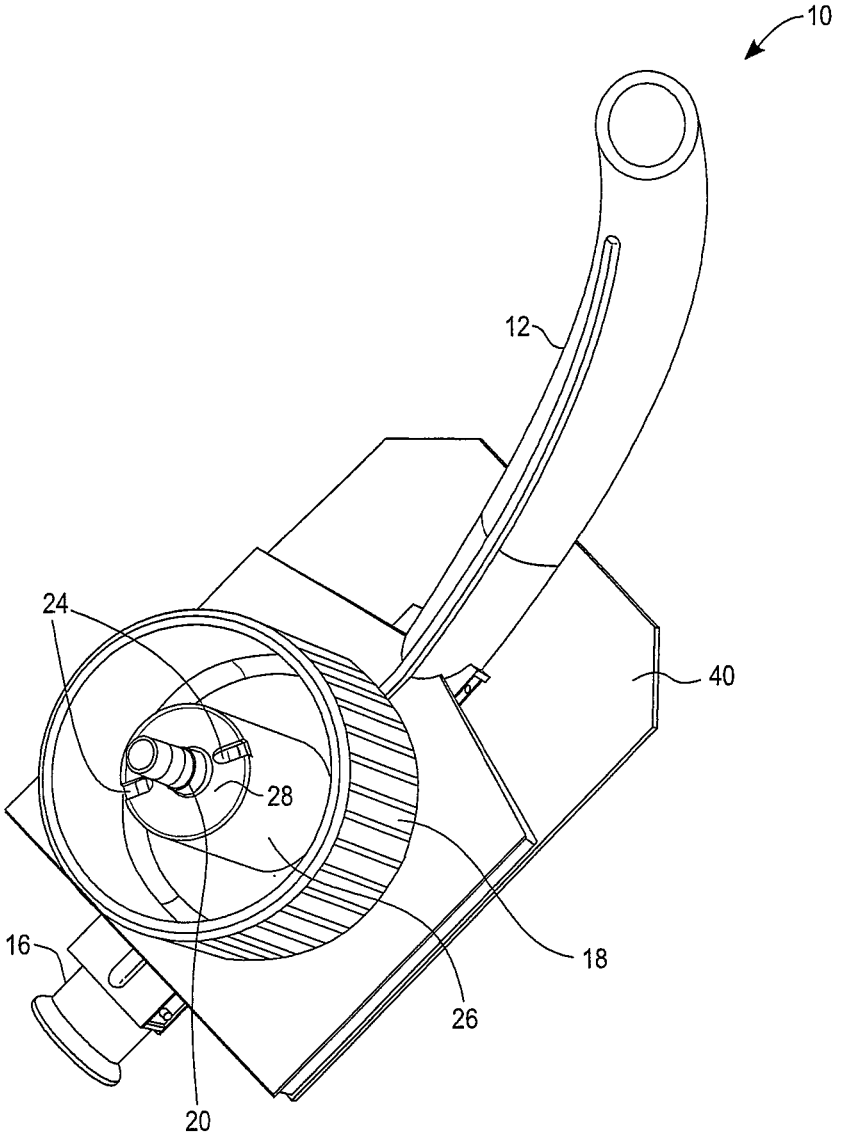
Fig. 4 (Prior Art)
FIG. 4 is a bottom perspective view of the dispense head of FIG. 1.

With reference to FIG. 4 the underside of dispense head 10 again shows a dispense spout 12 on one side of the device and gas input 16 on the opposing side. Cap 18 is mounted on body 40 and extends about the back of the wine bottle. A tube mount 20 on tapered cylinder 26 allows attachment of a tube which extends to the bottom of a wine bottle. Gas ports 24 allow the flow of gas into a wine bottle to establish a pressurizable head of gas over the wine in a wine bottle.

Figure 5:
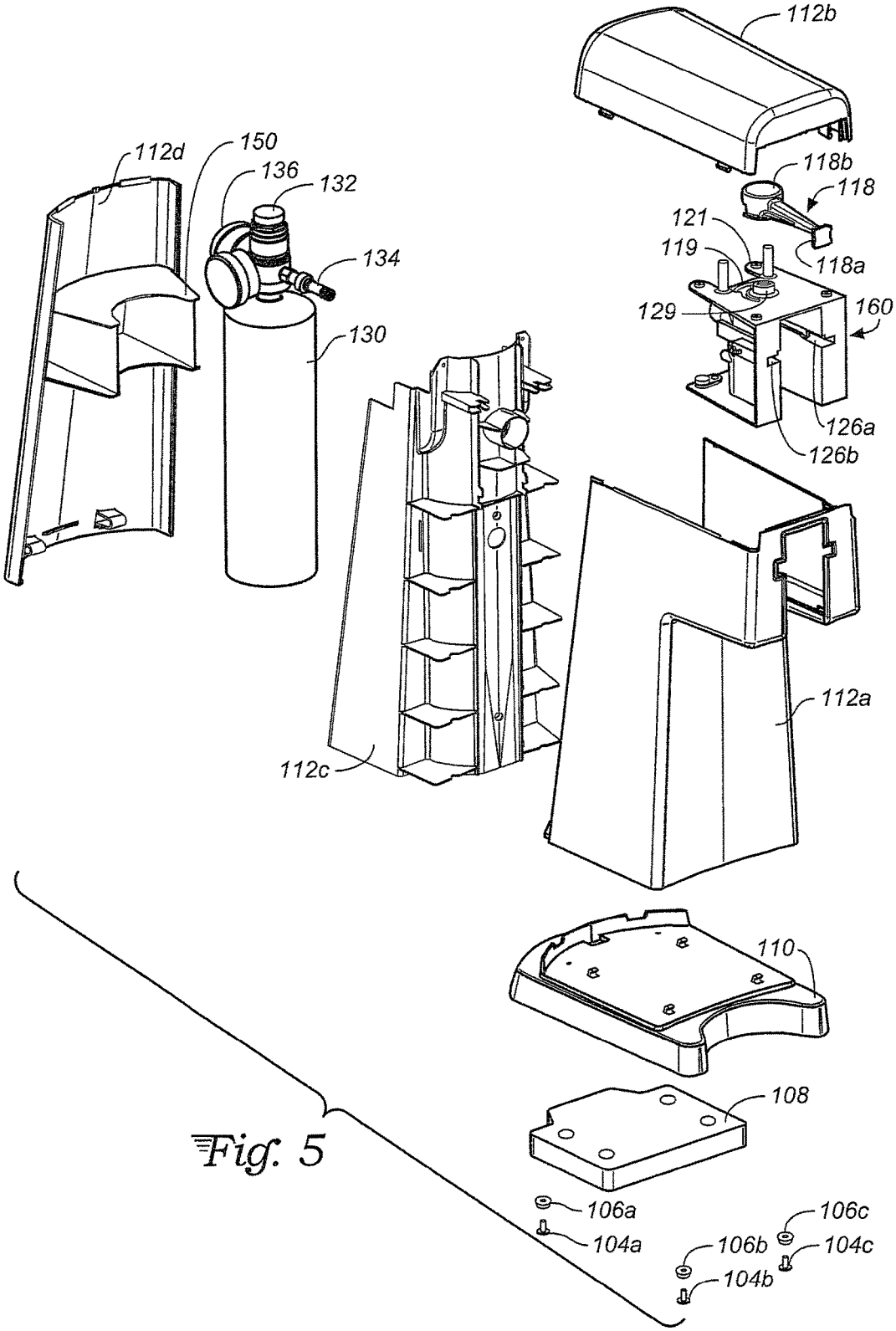
FIG. 5 is an exploded view of a manually-activated, single-bottle wine dispenser embodiment.

In the exploded view of FIG. 5, the housing includes a housing base 110, which may have an inserted base weight 108. Secured onto base weight 108 are rubber feet 106*a-c* secured by mounting screws 104*a-c*. Onto base 110 is secured housing front 112*a*. An interior structure 112*c* is positioned within the housing, between housing front 112*a* and housing rear 112*d*. A partial collar 150 on housing rear braces the gas cylinder 130 within the housing. Gas cylinder 130 includes a gauge 136, a regulator 132 and a gas supplying stem 134.

Housing front 112*a* holds an insert 160 having a pair of opposed slots 126*a*, 126*b*. These slots act as the guides for the dispense head to be frictionally held on the housing, with the gas input port of the dispense head receiving gas flow from the gas stem 134 on the gas cylinder 130. An arm 118 having a pour handle 118*a* is secured within the housing under the housing top 112*b*. A pair of springs 119, 121 keeps the handle in position until moved. When a user pushes a handle in a first direction, a head 118*b* rotates a rotating member 129. The rotating member can be rotated in two directions, by moving handle 118 right or left. In one direction, the valve on the dispense head is rotated in a first direction. This channels gas through the valve and other element such that gas flows into the dispense head, into the container, and out the spout of the dispense head without dispensing liquid. This allows the gas from within a container to be purged and replaced with a non-reactive dispense gas (such as argon). If the handle is pushed in the other direction, the valve is rotated such that the gas flows into the head space over liquid in a wine bottle. Liquid is displaced into an intake tube on the dispense head. The liquid will flow to the dispense spout.

Figure 6:
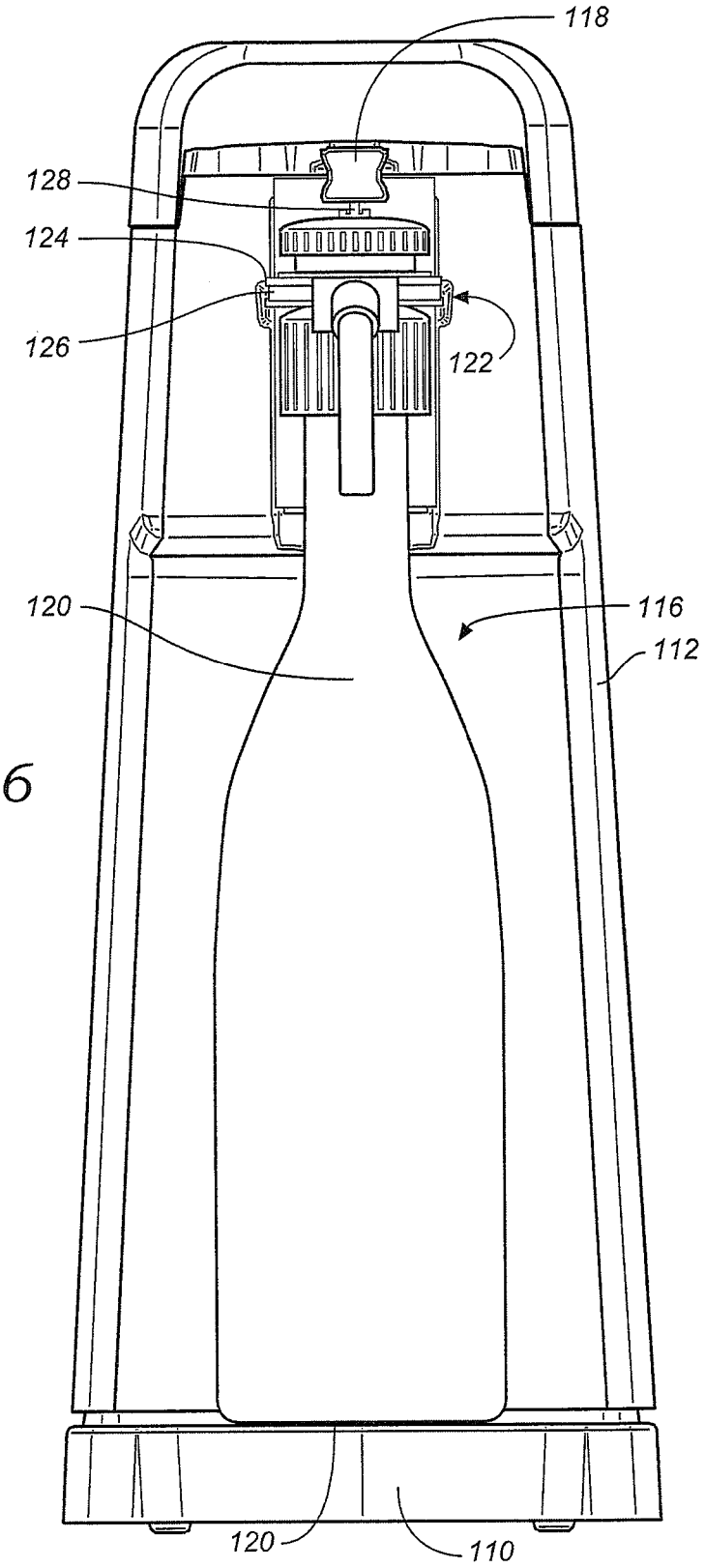
FIG. 6 is a front view of the assembly wine dispenser embodiment of FIG. 5.

With reference to FIG. 6, the assembled single bottle, manual dispenser shows the dispense head inserted into a bottle 120. The system includes a housing 112 having a base 110. The shape of housing 112 defines an alcove 116. A dispense head 122 inserted onto a wine bottle 120 allows the wine bottle to hang in the alcove. The dispense head has side runners 124 inserted onto a pair of opposed slots 126 in the upper portion of the housing. An arm 118 has a head at an end opposite the handle which engages with the tab 128 on the rotary valve secured to the wine bottle.

Figure 7:
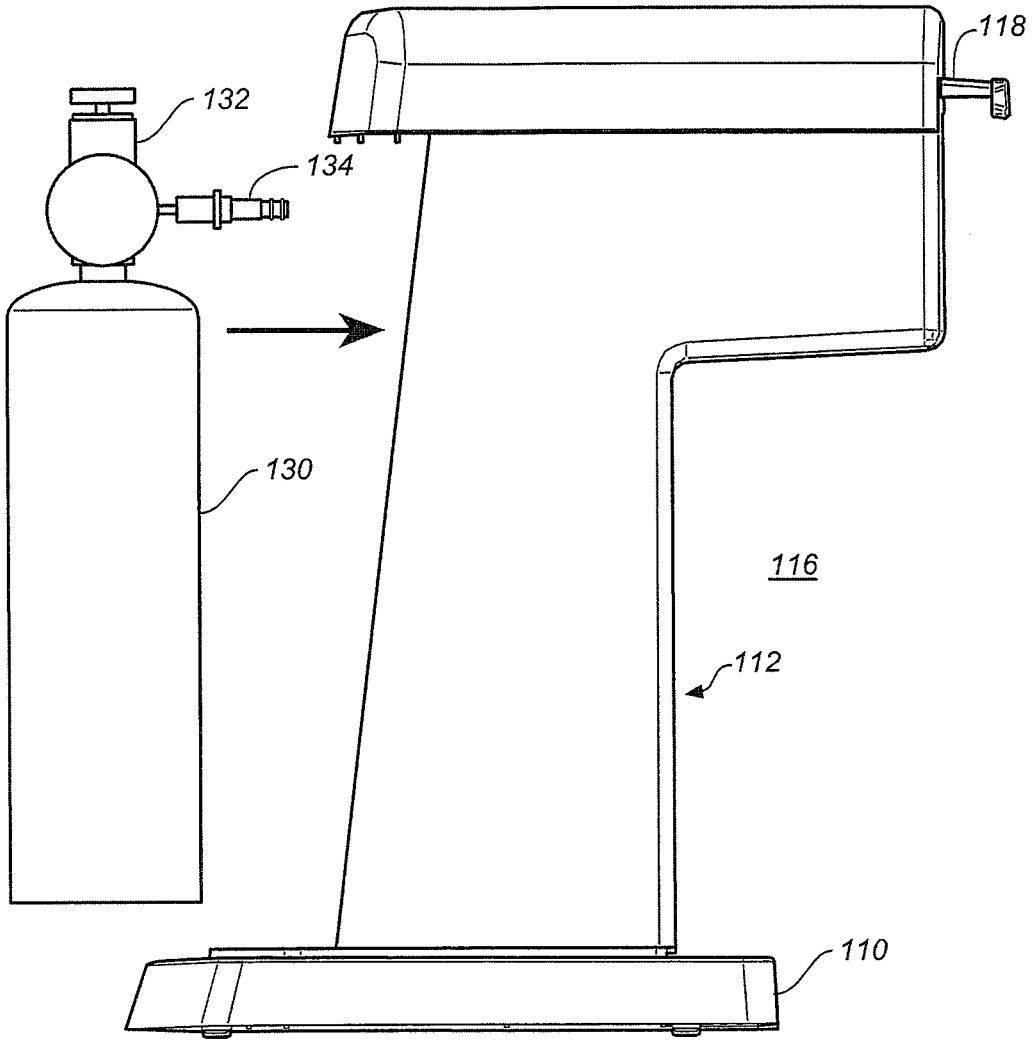
FIG. 7 is a side view of the wine dispenser embodiment of FIG. 5 with a gas cylinder shown before insertion.

With reference to FIG. 7 the housing 112 having base 110 and defined alcove 116 is shown from the side. A gas cylinder 130 removed from this rear of the unit is shown. The gas cylinder 130 includes a stem 134 that extends into the housing and through an opening. This allows the gas intake port on the dispense head to mount onto the gas stem. A Schrader valve on the head opens by pressing into contact with stem 134, allowing gas to flow into the gas intake port on the dispense head. A regulator 132 provides controllable regulation of the gas pressure.

Figure 8:
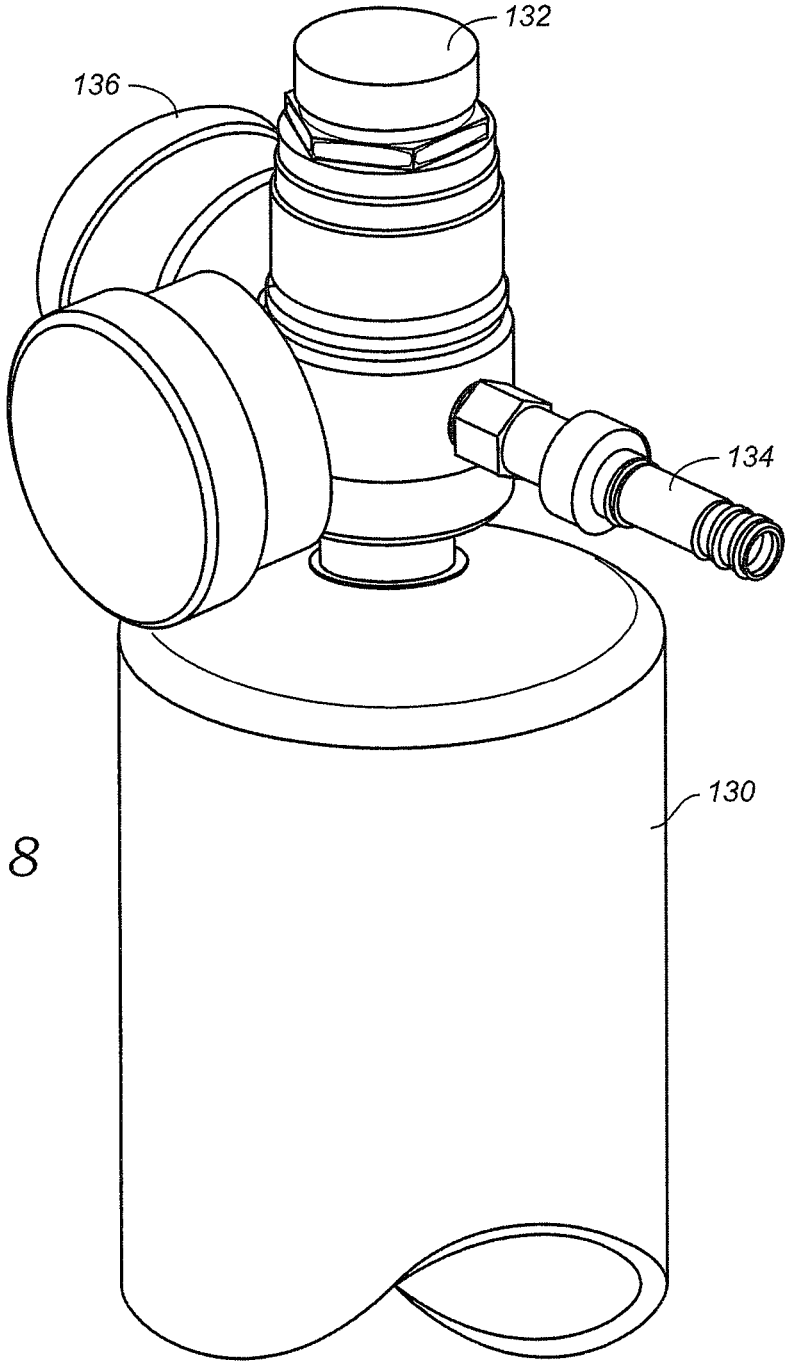
FIG. 8 is an upper perspective view of the upper portion of a gas cylinder.

As shown in FIG. 8, the gas cylinder 130 includes a stem 134 that can provide the gas to a dispense head. A regulator 132 provides adjustable control of the pressure of the supplied gas. A gauge 136 allows a user to view the gas pressure.

Figure 9:
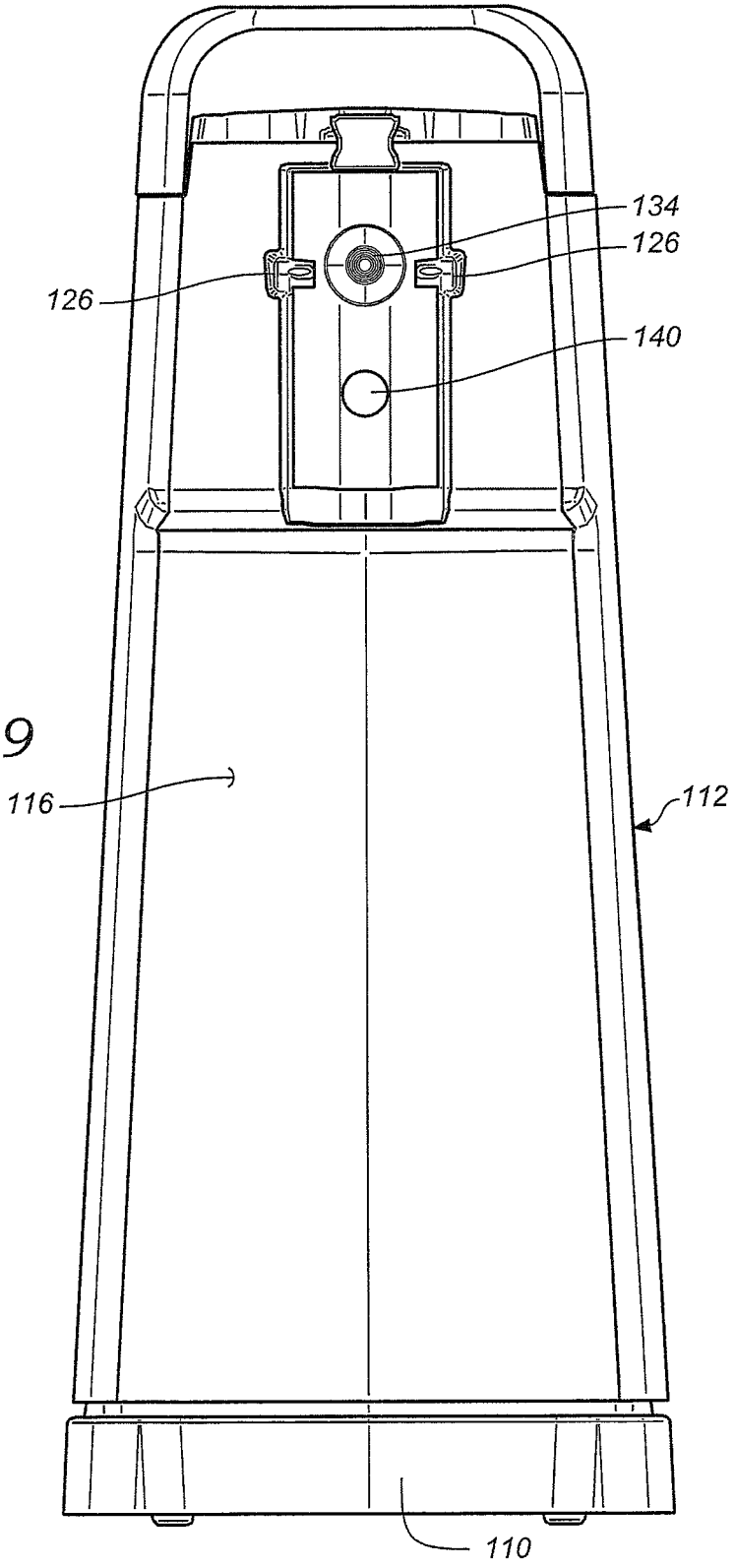
FIG. 9 is a front view of a wine dispenser embodiment showing a modified bay.

An alternate embodiment is shown in FIG. 9. In this front view of the housing 112 having base 110 shows the alcove 116. The dispense head is mounted on the opposing slots 126. The gas stem 134 extends through the housing. A second opening 140 below the gas stem opening on the housing allows adaptation to a keg of wine with the wine dispensing head with keg adapter shown in FIG. 10.

Figures 10A, 10B:
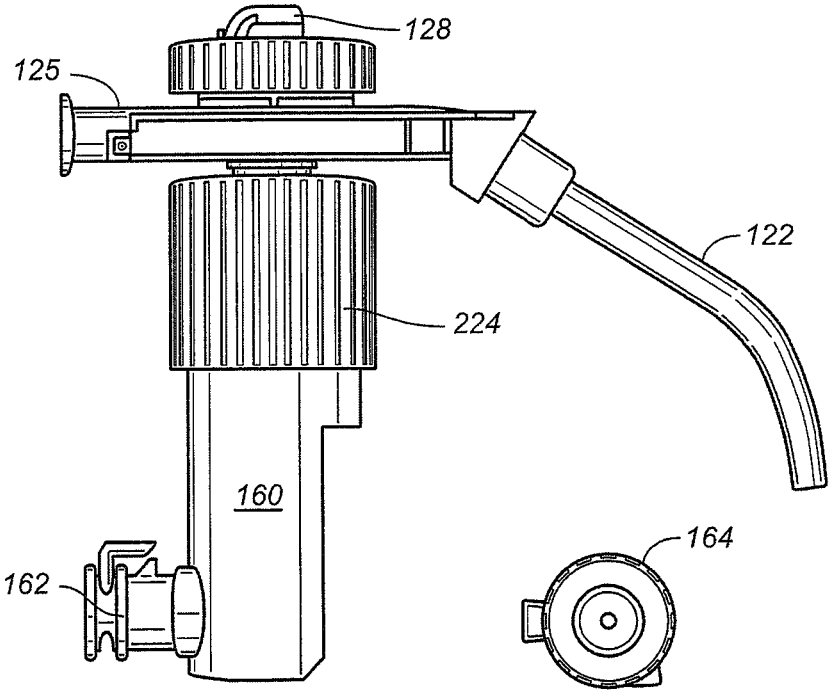
FIG. 10A is a side view of a dispense head with a keg adapter.
FIG. 10B is an end view of a keg source slip joinable to the keg adapter of FIG. 10A.

With reference to FIG. 10, a wine dispensing head with a keg adapter is shown. As with the wine bottle adapter, a tab 128 is rotated to rotate a valve and align pathways within the valve to dispense liquid or purge gas. The gas is accessed through input port 125. Wine flows to spout 122 where it is dispensed. In this device, collar 224 is annularly disposed around wine intake 160. Wine input port 162 can clip onto wine output port 164 in FIG. 10B attached to a tube to the keg. The keg has its own pressure source to displace wine. Wine intake 160 functions like the wine intake tube.

It is also possible to adapt the present system to keep sparkling wine preserved. The standard dispense head is modified. No intake tube is used, so no pathway to the pour spout exists. The dispense head is placed on a bottle containing sparkling wine, and the gas source allows introduction of the inert gas into the bottle by rotation of the valve. The head space is purged and the inert gas is introduced at a sufficient pressure to prevent the sparkling wine from going flat.

The present embodiments are used in an "liberated wine bottle" type system. A "liberated wine bottle" system is any system that allows wine preservation and dispensing in which a sealed wine bottle may be removed from the dispensing system and later replaced into the dispensing system. An illustration of such a liberated wine bottle system is found in U.S. Pat. No. 7,712,631, hereby incorporated by reference for all purposes herein. FIGS. 1-4 illustrate a dispense head developed for a liberated wine bottle system.

The present embodiments, considered broadly, allow a manually operated liberated wine bottle system. Such a system would include a housing containing a gas source. The gas source would allow a dispense head, mounted on a wine bottle, to both preserve the wine and to dispense wine by displacing a volume of wine. To accomplish this, the gas source is mounted such that a supply stem on the gas tank can dock with a gas input member on the dispense head. In one example, Schrader valve technology is used, and the docking is similar to that of a Schrader valve and a pump head for pumping gas through the Schrader valve.

The housing includes a bay where the dispense head is received. When the dispense head is held in this bay, the dispense head docks with the gas source supply stem. A dispense system user actuated drive mechanism engages with the dispense head. The user actuated drive mechanism can be moved by a user into multiple positions. In a first position, the drive mechanism engages with the dispense head to cause gas flow through a stopper in the dispense head and into and out from the head space above the liquid in a bottle onto which the dispense head stopper is mounted. The purged gas is released through a dispense spout on the dispense head. In a second position, the drive mechanism engages the dispense head to cause gas flow through a stopper, into the head space, displacing wine into an intake tube. The wine then flows to a dispense spout.

It should be recognized that the system uses a dispense head, but the dispense head is not part of the system. The liquid dispense system must utilize a dispense head, much like a media reading drive would utilize a readable media to function. However the readable media is not part of the reader, and the dispense head is separate from the present system.

Such a dispense head must include:

a. A gas intake port;

b. A dispense spout;

c. A stopper, insertable into the neck of a bottle;

d. An intake tube extending from the stopper into the bottle;

e. Gas passageways through said stopper, such that a head of gas can be introduced over the liquid in a bottle;

f. A mechanism to change flow pathways, in which at least two pathways exist. In a "pour" pathway, the gas displaces liquid by flowing through the stopper into the head space and liquid is dispensed in the intake tube and flows to the dispense spout. In a "purge" pathway, liquid flows through the stopper through a first stopper pathway, flows into the head space over the liquid in a bottle, and then flows from the stopper out of the spout. This may be used to purge air from above the wine, replacing it with an inert gas, thereby preserving the wine. It may also be used to purge any remaining liquid from the dispense spout. When not in the pour or purge pathway, the mechanism allows the bottle to be sealed. When the bottle is sealed containing only liquid and the preserving gas, the wine will be preserved, and will not degrade. In contrast, an open bottle of wine exposed to air will, over time, react and begin to degrade. The mechanism is able to be manipulated by a dispense system. For example, a rotary valve has a tab that may be rotated by the system by an engaging rotating member on the system. However, non-rotating mechanism to change flow pathways are envisioned. For example, a linear sliding valve could also be used to align a "pour" and "purge" pathway.

In the present invention, a dispense head is defined as a component including above components a-f.

What is claimed is:

1. A manually operated liberated wine bottle type dispense system, comprising:

a housing;

a gas source within said housing, said gas source having a supply stem extending into a bay in said housing; and a manually actuatable drive mechanism mounted on said housing positioned to engage with a dispense head which retains a bottle, wherein said manually actuatable drive mechanism may be positioned in a first position in which it causes said dispense head to allow liquid to flow from the bottle through a dispense head pour spout; and a second position in which gas is purged from said bottle.

2. An apparatus for dispensing wine from a wine holding container fitted with a dispense head, the apparatus comprising:

a housing base;

a housing front mounted on said housing base;

a dispense head bay in said housing front, said bay having a pair of opposed slots for slideably receiving said dispense head;

a housing rear mounted onto said housing front, defining an enclosed space;

a housing top secured over said housing front and housing rear;

a gas tank mounted within said enclosed space;

a gas providing stem extending from said tank, through an opening in said housing and into said bay, allowing a gas intake port on said dispense head to receive gas from said gas providing stem when said dispense head is slid into said dispense head bay; and a mechanical valve rotator positioned below said housing top, said mechanical valve rotator allowing rotation of a rotatable tab on said dispense head, said mechanical valve rotator configured to rotate said valve in a first direction in which gas is purged from a head space in said wine holding container and rotate said valve in said second direction in which wine is dispensed from said container.

3. The apparatus of claim 2, wherein said mechanical valve rotator includes an arm extending from a front, upper region of said housing, said arm having a tab engaging head within said housing.

4. The apparatus of claim 2, wherein said gas tank includes a regulator and a gauge.

5. The apparatus of claim 2, wherein said housing includes an upper opening through said housing for said gas stem and a lower opening for a keg tube mount on said dispense head.

6. A wine dispenser comprising:

a housing having a base, a body extending from the base, and an overhang extending horizontally beyond the base; and a bay defined in said overhang:

a pair of opposing, parallel slots located at said bay, said slots allowing tracks on received dispense head to slidably fit into such slots, whereby a wine bottle mounted on said dispense head is held in an alcove defined below said overhang;

a gas tank mounted in a retaining mount within said housing;

a gas supply stem extending from said gas tank into said bay.

* * * * *